United States Patent [19]

Haaser

[11] Patent Number: 4,594,272

[45] Date of Patent: Jun. 10, 1986

[54] PROCESS AND DEVICE FOR MANUFACTURING SHEET METAL OR GALVANIZED STEEL STRIP DEVOID OF A PURE ZINC COATING ON AT LEAST ONE SIDE

[75] Inventor: Robert Haaser, Truchtersheim, France

[73] Assignee: Union Siderurgique du Nord et de l'Est de la France (USINOR), Puteaux, France

[21] Appl. No.: 739,080

[22] Filed: May 29, 1985

[30] Foreign Application Priority Data

May 30, 1984 [EP] European Pat. Off. ..... 84401121.3

[51] Int. Cl.[4] ..... B05D 3/12; C23C 2/16; C23C 2/22

[52] U.S. Cl. ..... 427/349; 118/56; 427/367

[58] Field of Search ..... 427/367, 349; 118/56

[56] References Cited

U.S. PATENT DOCUMENTS

| | | | |
|---|---|---|---|
| 1,933,401 | 10/1933 | Ward | 91/70.2 |
| 3,260,577 | 7/1966 | Mayhew | 29/183.5 |
| 3,383,189 | 5/1968 | Sendzimir | 29/196.5 |
| 4,071,643 | 1/1978 | Pratt et al. | 427/292 |
| 4,120,997 | 10/1978 | Franks et al. | 427/349 X |
| 4,291,074 | 9/1981 | Schoeps et al. | 427/349 X |

FOREIGN PATENT DOCUMENTS

| | | |
|---|---|---|
| 732591 | 3/1943 | Fed. Rep. of Germany . |
| 1602732 | 4/1977 | United Kingdom . |

OTHER PUBLICATIONS

Patent Abstracts of Japan, vol. 4, No. 69 (C-11)(551), May 22, 1980, p. 59C11; & JP-A No. 55 34670 (Hitachi Seisakusho) 11/03/80, Abstract.

FR-A-1 No. 279 624 (Armco Steel Corp.), Abstract, p. 2, col. 2, lines 2,3.

EP-A-0 No. 011 547 (Laminoirs De Strasbourg), FIGS. 1-5, claim 1; FIG. 6, claims 2-7.

*Primary Examiner*—James R. Hoffman

*Attorney, Agent, or Firm*—Cushman, Darby & Cushman

[57] ABSTRACT

The invention relates to a process for manufacturing a strip of hot galvanized sheet steel devoid of a coating of pure Zn or a coating based on Zn on at least one side of the strip, comprising passing the strip continuously in a conventional dipping galvanization bath, wiping by pneumatic means a part of the coating of liquid Zn deposited on the strip, and subjecting at least one side of the strip to a mechanical action for completely eliminating the coating based on zinc which is not alloyed to the iron, by allowing to subsist only a thin iron-zinc alloy layer, said mechanical action on the layer of coating based on zinc which is still liquid being exerted by means of a brush at least the bristles of which are energetically cooled. The invention also provides a cooled brushing device (10) for carrying out the process.

13 Claims, 4 Drawing Figures

PROCESS AND DEVICE FOR MANUFACTURING SHEET METAL OR GALVANIZED STEEL STRIP DEVOID OF A PURE ZINC COATING ON AT LEAST ONE SIDE

The present invention relates to the manufacture of metal sheets or galvanized steel strips, which are in particular capable of being press-formed.

There are known in particular from the European patent No. 0011547 a process and a device for manufacturing hot galvanized press-formable steel sheets in which, after dipping in a bath of a liquid based on molten Zn, one of the sides of the strip is subjected to a mechanical action, in particular a brushing, in a region where the coating of Zn present on the sheet passes through a liquid-solid transitional state which is characterized by its friability. This state is theoretically reached after the solidification of the zinc.

However, from the practical point of view on an industrial manufacturing line, the brushing at this point poses the problem of the exact determination of its height relative to the level of the bath, bearing in mind the temperature of the latter, the thickness of the strip, the rate of feed of the strip and also the intensity of the operation of the pneumatic devices which are employed for partly wiping the coating of the deposited Zn by rendering it uniform.

An object of the present invention is to overcome this drawback by improving the facility of the control of the plant carrying out the process on an industrial scale, which is also accompanied by an improvement in the quality of the product and of its interest from the economic point of view bearing in mind the reduced losses for the regulation in each manufacturing batch.

The present invention therefore provides a process for manufacturing a hot galvanized sheet steel strip devoid of a coating of pure Zn or of a metal based on Zn on at least one side, comprising passing the strip continuously in a conventional dipping galvanization bath, wiping by pneumatic means a part of the coating of liquid Zn deposited on the strip and subjecting at least one side of said strip to a mechanical action for completely removing the coating based on zinc which is not alloyed to the iron by allowing to subsist only a thin iron-zinc alloy layer, characterized in that said mechanical action is exerted on the layer of coating based on zinc which is still liquid by means of a brush at least the bristles of which are energetically cooled.

According to another feature of the invention, the brush is of metal and is cooled by a forced gaseous current in which the brush is placed. Moreover, a current of cooling fluid flows through its hollow central shaft.

In the following part of the present description, there is employed for reasons of simplification the expression coating of Zn or based on Zn for designating a coating deposited from a dipping galvanization bath which may contain other metals such as, for example, aluminium in proportions which vary within a wide range.

The originality of the present invention resides therefore in the fact that the coating of zinc is brushed in the liquid state. However, in order to avoid soiling or clogging of the brush, it is essential to sufficiently cool its bristles so as to cause the solidification of the liquid zinc in contact with the bristles of the brush all the more so as the quantity of Zn to eliminate is greater and the temperature of the zinc is higher. Thus, the improvement brought about by the invention permits avoiding the difficulty of the relatively critical regulation of the height of brushing, which is of a considerable interest bearing in mind the variations in the rate of feed which a galvanization line in operation may undergo. Further, upon changes in parameters, such as the thickness of the strip, one is no longer obliged to determine the brushing region in a relatively precise manner and thus to vary the height of the brushing device in a vertical plane above the surface of the zinc bath.

As concerns the industrial carrying out of the invention, this advantage has for result that no device for regulating the height of the brush relative to the surface of the zinc bath is necessary and that the brush may therefore be maintained at a predetermined fixed level in a horizontal plane.

However, the invention proceeds from the same inventive concept as in the European patent No. 011547 of which it is an improvement, since, in order to obtain the desired result, namely the elimination of the coating of non-alloyed Zn, it is necessary, if a layer of liquid zinc is brushed, to energetically cool the bristles of the brush, which produces, by a thermal exchange with the cold bristles of the brush which come into contact with an elementary region of zinc surrounding the end of the bristle, the passage of this non-alloyed zinc coating through its liquid-solid transitional state characterised by its great friability.

The energetic cooling of the metal bristles of the brush is achieved by placing the latter in a forced gaseous current which in practice is air.

The forced gas current exerts a double action of a cooling of the bristles of the brush and a solidification in the form of solid particles of the droplets of liquid Zn which may have been projected in the course of the brushing.

However, it must be noted that the energetic cooling of the bristles of the brush is a function of the amount of liquid zinc to be eliminated from the strip. Thus, for a line operating at a low speed, the simple natural ventilation of the brush resulting from the very fact of its rotation in the surrounding air, may be sufficient, especially when the coating of liquid Zn has a low temperature.

Moreover, the hollow shaft of the brush is cooled in the conventional manner by a circulation of a cooling fluid.

According to another feature of the invention, means are provided in addition to the brush-cooling means for collecting the particles of zinc produced.

The invention also provides a brushing device for carrying out the process of the invention which comprises a support located along the path of the strip above the level of the surface of the zinc bath and carrying a rotary cylindrical brush whose bristles have their ends in contact with the surface of the strip in front of which the brush is placed, and at least a counter support roller in contact with the opposite side of the strip, characterized in that the brush is placed in a casing for a forced circulation of a gaseous cooling fluid.

According to another feature of the invention, this casing extends to a great extent in the direction perpendicular to the axis of the strip, beyond the edges of the latter and includes two regions separated by a wall, the first region being the forced cooling fluid circulating region and the second region being a region for collecting or recovering particles of zinc which are eliminated from the brushed surface of the strip.

The second region preferably includes inclined flaps which guide the particles of solidified zinc toward a discharge conduit connected to a hopper recovering the finely-divided particles of solidified zinc.

According to yet another feature, the device comprises, in confronting relation to the side opposed to the brushing side of the strip, vertical deflectors defining vertical baffles which guide the gaseous flow and prevent the re-deposition on the side carrying the coating of zinc of the particles produced by the brushing.

According to one embodiment, these vertical deflectors are placed in such manner that they surround the support roller in a large part of its periphery.

According to a modification, these deflectors are divided in a substantially central region by a wall in the shape of an inclined plane oriented toward the strip and leading to a trough for recovering the dust or particles of Zn.

The invention will be described in detail hereinafter with reference to the accompanying drawings showing one embodiment. In these drawings.

Figure 2:
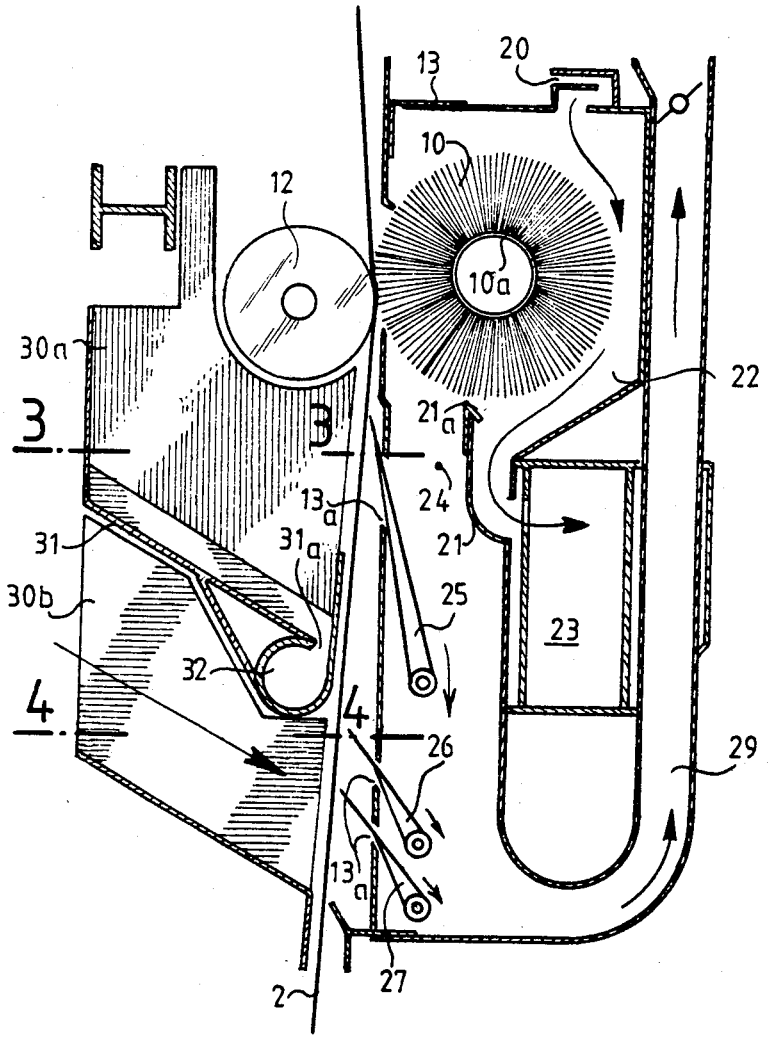
FIG. 2 is an side elevational and a sectional view of the brushing device shown in FIG. 1.
Figure 3:
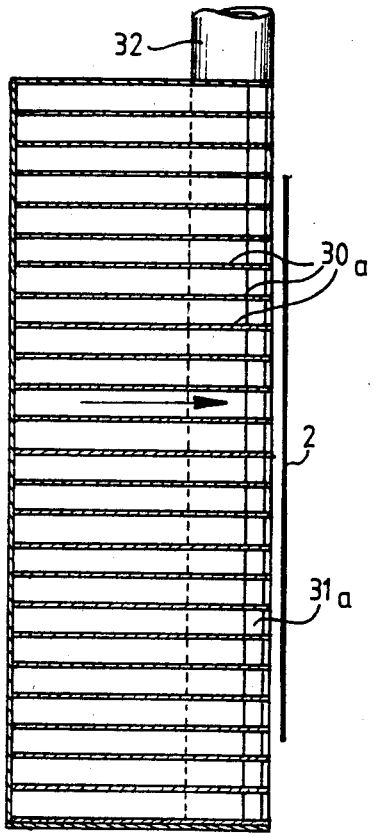
Figure 4:
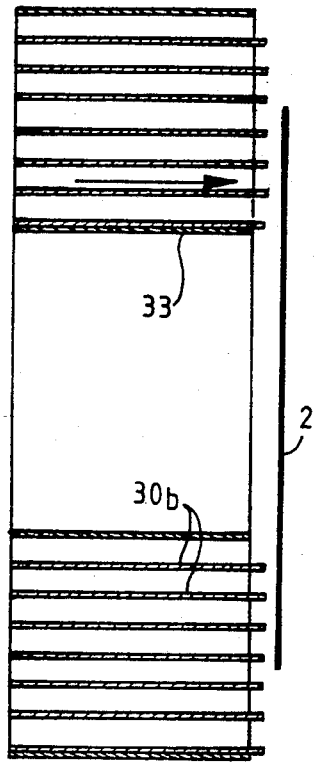

FIGS. 3 and 4 are respectively sectional views taken on lines 3—3 and 4—4 of FIG. 2.

Figure 1:
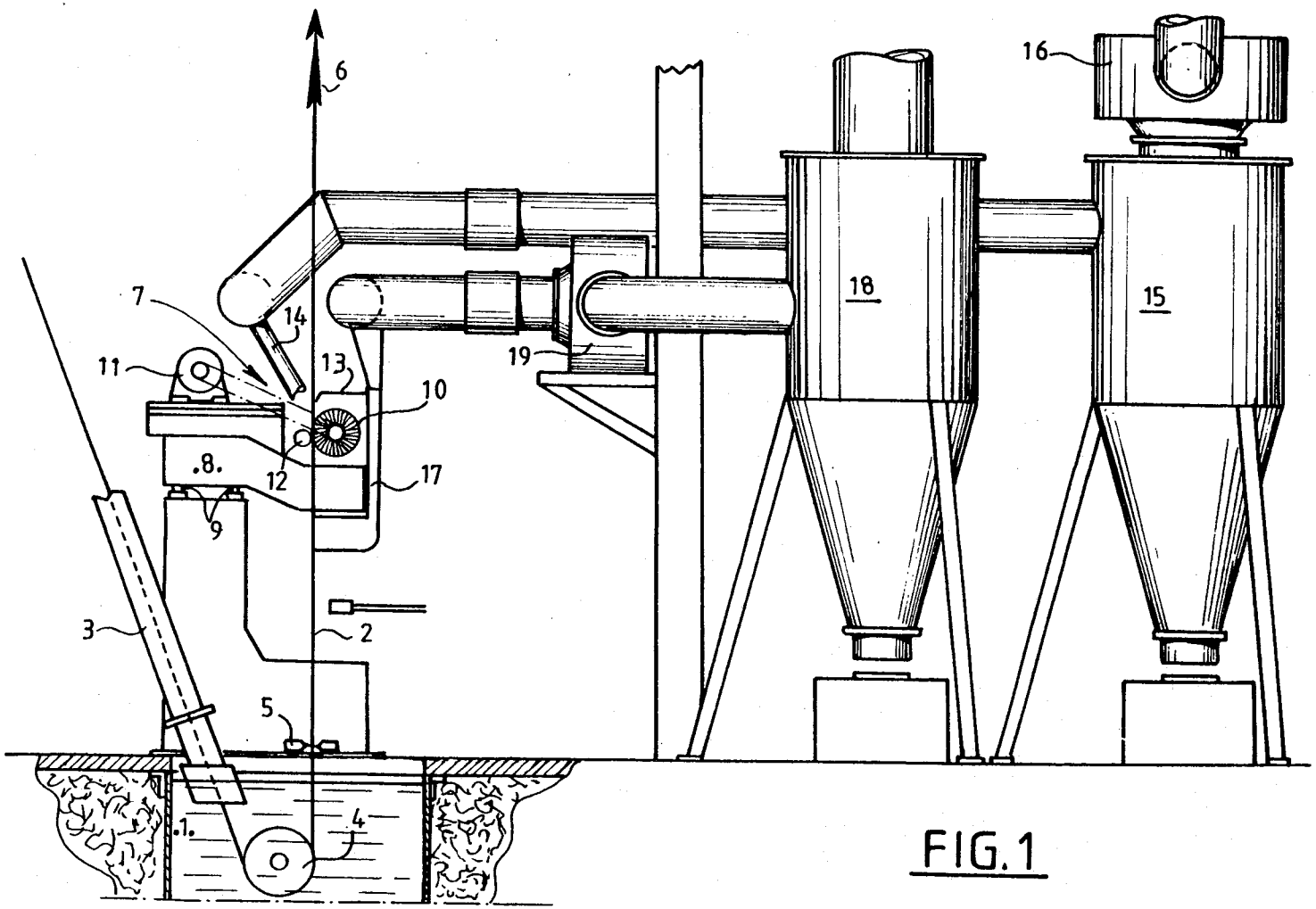
FIG. 1 is a partial diagrammatic elevational view of a plant according to the present invention.

FIG. 1 shows a conventional dipping galvanization plant comprising a bath 1 of molten Zn into which penetrates a strip 2 of sheet steel issuing from a furnace (not shown) and travelling in a passageway 3 in a protective atmosphere. This strip is sent back by a roller 4 at the bottom of the tank and issues vertically from the zinc bath while being wiped by a pneumatic device 5 located in the vicinity of the surface of the zinc bath.

The strip continues its vertical path as shown by the arrow 6 after having travelled through the device for brushing the zinc coating according to the present invention.

This device comprises a support 8 which is movable in translation in a horizontal plane in a direction parallel to the plane of the strip, for example on rails 9.

A brush 10 is mounted on this support and driven in rotation by means (not shown) including a motor 11 mounted on the support. Preferably, the hub 10*a* of this brush is hollow and a cooling fluid flows therethrough.

A counter roller 12 in confronting relation to the side of the strip opposed to the brushing side provides a support for the strip which it urges in a direction of the bristles of the brush so that the plane of the strip is slightly intersecting the envelope of the end of the bristles of the brush 10.

The brush 10 is disposed in a casing 13 which will be described hereinafter in detail with reference to FIG. 2.

This casing 13 is connected, on one hand, to a circuit 14 affording a forced circulation of a cooling gas for the brush and opening into a hopper 15. The circuit is subjected to an aspiration by a blower 16.

The casing 13 is connected, on the other hand, to a circuit 17 for drawing off the dust and opening into a hopper 18 and equipped with another blower 19.

The two circuits 14 and 17 are thus subjected to an aspiration so as to limit to the maximum extent the emanation and circulation of particles of dust.

In FIG. 2, the casing surrounding the brush 10 comprises an inlet baffle 20 for the entrance of the current of cooling gas which is subjected to a forced circulation by the effect of aspiration. It is moreover divided into two distinct regions by a wall 21 whose upper edge 21*a* is disposed in the vicinity of the lower generatrix of the brush 10.

A brush-cooling current of gas circulates in the first region 22. This region of forced circulation surrounds the major part of the outer surface of the cylindrical brush so as to ensure the most effective cooling thereof and is located in a position opposed to the strip 2 relative to the brush 10. This region of forced circulation of the cooling gas communicates with a box 23 connected to the cooling gas aspiration circuit 14.

The second region 24, separated in a practically fluid-tight manner from the region 22 by the wall 21, at least as concerns particles of zinc produced by the brushing, is located in confronting relation to the side of the strip carrying a coating of liquid zinc which will be brushed by the brush 10.

This region 24 includes deflector flaps 25, 26, 27 in the form of inclined planes which guide the particles of solidified zinc ejected downwardly from the casing 13 where they are recovered by aspiration by the conduit 29 connected to the circuit 17 aspirating the zinc dust. These flaps are preferably orientable about horizontal axes and extend through slots 13*a* in the casing.

Deflectors 30*a*, 30*b*, evenly spaced apart and surrounding the support roller 12 in a large part of its periphery, are placed vertically, as can be seen in FIG. 3, so as to guide vertically the gaseous current existing on the side of the strip opposed to the brushing side. These vertical deflectors 30*a*, 30*b* form vertical baffles preventing the possible re-deposition of the zinc dust produced by the brushing of the opposed side of the strip and which could have a disadvantageous effect on the side carrying the conventional coating of zinc.

The vertical deflectors 30*a*, 30*b* are separated in a substantially median region by a wall 31 in the shape of an inclined plane which extends toward the strip 2 and is perpendicular to the deflectors. This inclined plane terminates along its lower edge in a trough 32 with which it defines a relatively slight slope 31*a*. The trough is connected to the circuit 14 circulating the brush-cooling gas (FIGS. 2 and 3).

The deflectors 30*b* located below the wall 31 are disposed preferably in two groups located in the vicinity of the edges of the sheet and separated by a central region 33.

As the casing 13 and the group of deflectors 30*a* and 30*b* have a substantially equal width and distinctly extend beyond the edges of the strip 2, as shown in FIGS. 3 and 4, the gaseous circulation current created around the strip 2 on the side thereof facing the supporting counter roller 12, is partitioned and canalized as indicated by the arrows in such manner as to prevent effectively any possible re-deposition of the particles of zinc produced by the brushing, beyond the edges on the side of the strip carrying the conventional zinc coating.

What is claimed is:

1. A process for manufacturing a strip of hot galvanized sheet steel devoid of a coating of pure Zn or a coating based on Zn on at least one side of the strip, said process comprising the steps of passing the strip continuously through a conventional dipping galvanization bath, wiping by pneumatic means a part of the coating of liquid Zn deposited on the strip, and subjecting at least one side of said strip to a mechanical action for completely removing the coating based on Zn which is not alloyed to the iron, by allowing to subsist only a thin iron-zinc alloy, said mechanical action being exerted on the layer of coating based on zinc which is still liquid by means of a brush having bristles, at least said bristles being energetically cooled.

2. A process according to claim 1, wherein the brush is of metal and cooled by a forced circulation of a gaseous current.

3. A process according to claim 2, wherein the gas is air.

4. A process according to claim 2, wherein the forced circulation is created by aspiration.

5. A brushing device for manufacturing a strip of hot galvanized sheet steel devoid of a coating of pure Zn or a coating based on Zn on at least one side of the strip, said brushing device being for combination with a bath of zinc and comprising a support located alongside a path of the strip leaving said bath and above the level of the surface of the bath of zinc, a rotary cylindrical brush carried by said support and having bristles which have ends thereof in contact with a first surface of the strip in front of which surface the brush is placed, and at least a counter support roller in contact with a second surface of the strip opposed to said first surface, a casing surrounding said brush and for connection to means for producing a forced circulation of a gaseous cooling fluid in said casing.

6. A device according to claim 5, wherein the strip has a longitudinal axis and the casing extends in a direction perpendicular to said axis to a great extent beyond edges of the strip and includes a wall dividing the interior of the casing into a first region and a second region, the first region being for connection to said means for producing a fixed circulation of a cooling fluid, and the second region being for a recuperation of dust or particles of zinc which are eliminated from said first surface of the strip brushed by said brush.

7. A device according to claim 6, wherein said wall extends to the vicinity of a lower generatrix of said brush.

8. A device according to claim 6, further comprising a hopper for the recuperation of finely-divided particles of solidified zinc, a discharge conduit connecting said hopper to said second region, and inclined flaps in said second region for guiding the solidified zinc particles to said discharge conduit.

9. A device according to claim 6, wherein each of said two regions is connected to a respective aspiration circuit.

10. A device according to claim 5, further comprising a hopper for the recuperation of finely-divided particles of solidified zinc, a discharge conduit connecting said hopper to said second region, and inclined flaps in said second region for guiding the solidified zinc particles to said discharge conduit.

11. A device according to claim 5, comprising in confronting relation to said second surface, vertical deflectors defining vertical baffles for guiding the gaseous flow and preventing the re-deposition on the surface carrying the coating of zinc of particles produced by the brushing.

12. A device according to claim 11, further comprising a trough for recovering dust and a wall defining an inclined plane oriented toward the strip and leading to said trough and dividing said deflectors into two groups of deflectors in a substantially central region of said deflectors.

13. A device according to claim 12, wherein the trough is connected to an aspiration circuit.

* * * * *